US005376619A

United States Patent [19]

Mochizuki et al.

[11] Patent Number: 5,376,619

[45] Date of Patent: Dec. 27, 1994

[54] SUBLIMATION-TYPE THERMAL COLOR IMAGE TRANSFER RECORDING MEDIUM

[75] Inventors: Hidehiro Mochizuki; Hiroyuki Uemura, both of Numazu; Yutaka Ariga, Fuji, all of Japan

[73] Assignee: Ricoh Company, Ltd., Tokyo, Japan

[21] Appl. No.: 67,791

[22] Filed: May 27, 1993

[30] Foreign Application Priority Data

Jun. 1, 1992 [JP] Japan ..... 4-165359
Apr. 5, 1993 [JP] Japan ..... 5-101940

[51] Int. Cl.[5] ..... B41M 5/035; B41M 5/38

[52] U.S. Cl. ..... 503/227; 428/195; 428/341; 428/913; 428/914

[58] Field of Search ..... 8/471; 428/195, 212, 428/913, 914, 341; 503/227

[56] References Cited

U.S. PATENT DOCUMENTS 4,880,768 11/1989 Mochizuki et al. ..... 503/227

*Primary Examiner*—B. Hamilton Hess

*Attorney, Agent, or Firm*—Oblon, Spivak, McClelland, Maier, & Neustadt

[57] ABSTRACT

A sublimation-type thermal color image transfer recording medium for transferring images onto an image receiving sheet by moving the sublimation-type thermal color image transfer recording medium with a speed of 1/n (n>1) relative to the image receiving sheet with a speed of 1 is composed of at least one support, and an ink layer formed on the support. The ink layer includes at least one dye-supply layer formed on the support, which is composed of a resin binder agent and one sublimable dye dispersed therein, such as a yellow sublimable dye, a magenta sublimable dye, and a cyan sublimable dye; and a dye-transfer-contribution layer formed on the dye-supply layer, which is composed of a resin binder agent and a sublimable dye with substantially the same color as that of the sublimable dye in the dye-supply layer, wherein the total of the sublimable dye contained in the dye-supply layer and that in the dye-transfer contribution layer, M g/m$^2$, and the value of M·1/n for each color ink section are in a predetermined relationship.

9 Claims, No Drawings

SUBLIMATION-TYPE THERMAL COLOR IMAGE TRANSFER RECORDING MEDIUM

BACKGROUND OF THE INVENTION

1. Field of the Invention

The present invention relates to a sublimation-type thermal color image transfer recording medium for multi-color image formation by use of an n-times-speed mode method, and more specifically to a sublimation-type thermal color image transfer recording medium which is capable of performing multi-color image formation without any reduction in image density even when the n-times-speed mode method is employed and which is advantageous over conventional sublimation-type thermal color image transfer recording media in view of the cost.

2. Discussion of Background

Recently, the demand for full color printing is increasing year by year, and the development of the full-color-printing preparation method is progressed. Recording methods for full color printing include the electrophotographic method, the ink-jet method, and the thermosensitive image transfer method. Of these methods, the thermosensitive image transfer method is most widely employed because of its advantages such as easy maintenance and noiseless operation, over the other methods.

In the thermosensitive image transfer recording method, an image receiving sheet is used, which is a so-called ink sheet and comprises a support and an ink layer formed thereon. The image receiving sheet is superimposed on a thermal image transfer recording medium in such a fashion that the surface of the image receiving sheet comes into contact with the surface of the ink layer.

To the above superimposed recording medium and image receiving sheet, electrically controlled thermal energy is applied to the recording medium side by use of a laser or a thermal head, so that an ink in the heated portion of the recording medium is imagewise transferred from the thermal image transfer recording medium to the image receiving sheet. Thus an image is formed on the image receiving sheet.

The thermosensitive image transfer recording methods can be roughly classified into two types, a thermal fusing image transfer type and a sublimation image transfer type, depending upon the kinds of inks employed.

In a thermal image transfer recording medium for the thermal fusing image transfer type recording method, an ink comprising a coloring agent dispersed in a thermofusible material is used in the recording medium, while in the sublimation image transfer type recording method, an ink comprising a sublimable dye dispersed in a binder resin is employed in an ink layer of a thermal image transfer recording medium.

When the two methods are compared, the sublimation image transfer type has the advantage that halftone images can be obtained without difficulty since a sublimation dye is transferred to the image receiving sheet in the form of individually separated molecules, corresponding to the amount of thermal energy applied from a thermal head. In addition to the above, the sublimation image transfer type recording method has many other advantages over the thermal image transfer type, so that the sublimation image transfer type recording method is considered to be one of the most suitable methods for full-color printing.

The sublimation image transfer recording method, however, has the shortcoming that its running cost is higher than those of the electrophotographic method, the ink jet method and other methods, because (a) it is necessary to employ not only coloring materials which directly contribute to the image formation, but also secondary members such as a support; (b) image formation is carried out with locally selective application of thermal energy to the thermal image transfer recording medium, which is hereinafter simply referred to as the ink sheet, and remaining unused portions of the ink sheet cannot be used again; and (c) there is a case where a yellow ink sheet, a magenta ink sheet, a cyan ink sheet and a black ink sheet are individually employed in order to obtain a full-color image.

To eliminate these shortcomings, the so-called n-times-speed mode method has been proposed, by which the running speed of an ink sheet is made slower than that of an image receiving sheet, so that the ink sheet can be used repeatedly.

However, when this n-times-speed mode method is employed in the sublimation-type thermal transfer recording method, it is practically difficult to perform a multiple printing, even when the dye-content in an ink layer of the ink sheet is increased large enough for multiple-printing, because there is a problem in the thermal diffusion of sublimable inks employed.

The inventors of the present invention proposed a sublimation-type thermal image transfer recording medium with a two-layered structure (Japanese Laid-Open Patent Application 2-586) to eliminate the above-mentioned problem. More specifically, this sublimation-type thermal transfer recording medium has such a structure that a dye-transfer-contribution layer with a relatively small dye-releasing capability is provided on a dye-supply layer with a large dye-releasing capability.

By use of the sublimation-type thermal transfer recording medium with the above-mentioned structure, the dye can be speedily replenished to the dye-transfer-contribution layer from the dye-supply layer, so that the ink is transferred from the dye-transfer-contribution layer to the image receiving sheet to form images thereon.

The above-mentioned thermal image transfer recording medium proposed by the inventors of the present invention has an excellent multi-printing performance so that image formation can be performed multiple times without any substantial decrease in image density even after multiple image transfer operations are repeated. However, it is necessary to minimize the amount of the dye contained in the recording medium, which constitutes the largest percentage of the manufacturing cost of the thermal image transfer recording medium, and to improve the manufacturing method of the recording medium.

For instance, in order to form a desired dye-supply layer comprising a sufficient amount of a dye for multiple image formation by using a conventional coating method, coating must be made two or more times for the formation of the dye-supply layer. As a result, the manufacturing cost is increased.

Moreover, when an ink-ribbon-shaped sublimation-type thermal image transfer recording medium, which is in general use, is produced, if a dye-transfer layer is prepared by a microgravure printing method, which is considered to be suitable for film formation, coating irregularity is often caused at the initiation of the coating or immediately before the termination of the coating. If this takes place, such coating irregularity has to be removed from the dye-transfer layer. This inevitably increases the manufacturing cost of the recording medium.

SUMMARY OF THE INVENTION

Accordingly, an object of the present invention is to provide a sublimation-type thermal color image transfer recording medium which is capable of forming multicolor or full color images multiple times by use of the n-times-speed mode method, with a minimized reduction in the image quality even after multiple image recordings, and which is convenient for use in practice and can be manufactured at a low cost because the amount of the sublimable dye contained therein is minimized by an improved manufacturing method thereof.

The above object of the present invention can be achieved by a sublimation-type thermal color image transfer recording medium for transferring images onto an image receiving sheet by moving the sublimation-type thermal image transfer recording medium with a speed of n ($n>1$) relative to the image receiving sheet with a speed of 1, comprising at least one support, and an ink layer formed on the support, which ink layer comprises at least one dye-supply layer formed on the support, comprising a resin binder agent and one sublimable dye dispersed therein, the sublimable dye being selected from the group consisting of a yellow sublimable dye, a magenta sublimable dye, and a cyan sublimable dye; and a dye-transfer-contribution layer formed on the dye-supply layer, comprising a resin binder agent and a sublimable dye with substantially the same color as that of the sublimable dye in the dye-supply layer, wherein the total of the sublimable dyes contained in the dye-supply layer and in the dye-transfer-contribution layer is M $g/m^2$, thereby forming at least one color ink layer section selected from the group consisting of a yellow ink layer section, a magenta ink layer section and a cyan ink layer section in the ink layer, the value of M.1/n for the yellow ink layer section is in the range of 0.2 $g/m^2$ to 0.5 $g/m^2$, the value of M.1/n for the magenta ink layer section is in the range of 0.3 $g/m^2$ to 0.8 $g/m^2$, and the value of M.1/n for the cyan ink layer section is in the range of 0.3 $g/m^2$ to 0.8 $g/m^2$, in which the value of "n" may be changed for each color portion.

DESCRIPTION OF THE PREFERRED EMBODIMENTS

As mentioned above, the sublimation-type thermal color image transfer recording medium according to the present invention is for transferring images onto an image receiving sheet by moving the sublimation-type thermal image transfer recording medium with a speed of 1/n ($n>1$) relative to the image receiving sheet with a speed of 1, and comprises at least one support, and an ink layer formed on the support. The ink layer comprises at least one dye-supply layer formed on the support, comprising a resin binder agent and one sublimable dye dispersed therein, the sublimable dye being selected from the group consisting of a yellow sublimable dye, a magenta sublimable dye, and a cyan sublimable dye; and a dye-transfer-contribution Layer formed on the dye-supply layer, comprising a resin binder agent and a sublimable dye with substantially the same color as that of the sublimable dye in the dye-supply layer, wherein the total of the sublimable dyes contained in the dye-supply layer and in the dye-transfer-contribution layer is M $g/m^2$, thereby forming at least one color ink layer section selected from the group consisting of a yellow ink layer section, a magenta ink layer section and a cyan ink layer section in the ink layer, the value of M.1/n for the yellow ink layer section is in the range of 0.2 $g/m^2$ to 0.5 $g/m^2$, the value of M.1/n for the magenta ink layer section is in the range of 0.3 $g/m^2$ to 0.8 $g/m^2$, and the value of M·1/n for the cyan ink layer section is in the range of 0.3 $g/m^2$ to 0.8 $g/m^2$, in which the value of may be changed for each color portion.

Furthermore, according to the present invention, the ink layer may further comprise a low-dyeable resin layer which is provided on the dye-transfer-contribution layer.

Furthermore, according to the present invention, the support may be a ribbon-shaped support comprising a plurality of portions corresponding to a plurality of ink layer group sections arranged in the longitudinal direction of the ribbon-shaped support.

Each of the ink layer group sections comprises a yellow ink layer section, a magenta ink layer section, and a cyan ink layer section, and the ink layer comprises (a) three dye-supply layers side by side formed on the ribbon-shaped support, a yellow dye-supply layer comprising a resin binder agent and a yellow sublimable dye, provided in the yellow ink layer section of the ribbon-shaped support, which is a first dye-supply layer, a magenta dye-supply layer comprising a resin binder agent and a magenta sublimable dye, provided in the magenta ink layer section, which is a second dye-supply layer, and a cyan sublimable dye comprising a resin binder agent and a cyan sublimable dye, provided in the cyan ink layer section, which is a third dye-supply layer, and (b) three-dye-transfer-contribution layers formed on the three-dye supply layers, a first dye-transfer-contribution layer formed on the first dye-supply layer, comprising a resin binder agent and a sublimable dye with a color which is substantially the same color as that of the sublimable dye in the first dye-supply layer, a second dye-transfer-contribution layer formed on the second dye-supply layer, comprising a resin binder agent and a sublimable dye with a color which is substantially the same color as that of the sublimable dye in the second dye-supply layer, and a third dye-transfer-contribution layer formed on the second dye-supply layer, comprising a resin binder agent and a sublimable dye with a color which is substantially the same color as that of the sublimable dye in the third dye-supply layer.

Each of the dye-supply layers can be formed by a screen printing method.

Furthermore, according to the present invention, a sensor marker may be provided in a boundary area between each of the ink layer group sections and/or in a boundary area between each of the yellow ink layer section, the magenta ink layer section, and the cyan ink layer section.

In addition, according to the present invention, the support,may be composed of a plurality of separate support members. In this case, at least one of the yellow ink layer section, the magenta ink layer section, and the cyan ink layer section is provided on any of the separate support members, thereby forming set of separate sublimation-type thermal color image transfer recording media.

In the n-times-speed mode method, both the image receiving sheet and the ink sheet are caused to run, with the running speed of the image receiving sheet being set so as to be n (n>1) times the running speed of the ink sheet to form images on the image receiving sheet to use the ink sheet multiple times, so that the ink sheet and the image receiving sheet are transported in such a manner that a preceding portion of the ink sheet and the following portion thereof partly overlap.

Therefore, the n-times-speed mode method is advantageous over an equal-speed mode method in that the variations of the amount of the residual ink in the ink sheet is made smaller than in the case of the equal-speed mode from the viewpoint of the recording history of the ink sheet as reported in the Journal of the Institute of Electronics and Communication Engineers, Vol. J70-C, No. 11, (1987. 11) pages 1537–1544.

When the sublimation-type thermal image transfer recording medium having an excellent multi-image formation performance disclosed in the previously mentioned patent application filed by the inventors of the present invention, is applied to the sublimation-type thermal image transfer recording method by use of the n-times-speed mode method, a full-color printing method can be significantly improved. However, the recording medium employed for the n-times-speed mode method must contain a larger amount of a sublimable dye per unit area therein than in the recording medium for the equal-speed mode or one-time recording. This is because the density of the image obtained by use of the multiple use recording medium is inevitably decreased after multiple image formation if the amount of the dye contained in the multiple use recording medium is about the same as that for the one-time use recording medium.

The manufacturing cost of the multiple use recording medium is increased in proportion to the amount of the dye per unit area in the recording medium since the sublimable dye cost occupies an extremely high ratio in the entire cost for manufacturing the sublimation thermal image transfer recording medium.

The inventors of the present invention have studied the amount of the ink to be contained in the sublimation-type thermal image transfer recording medium when the n-times-mode speed method is employed, and have made the present invention.

A suitable amount of the sublimable dye employed in the present invention is determined as follows:

When the total of the sublimable dye contained in the dye-transfer-contribution layer and the sublimable dye contained in the dye-transfer layer is defined as M g/m$^2$ in the sublimation-type thermal image transfer recording medium employed by use of the n-times-speed mode method, the amount of each sublimable dye in each ink layer section is determined by the value of M.1/n in which 1/n is the running speed of the sublimation-type thermal color image transfer recording medium relative to an image receiving sheet. The value of n is more than 1, and preferably in the range of 2 to 30. More specifically, the value of M.1/n for a yellow ink layer section is in the range of 0.2 to 0.5 g/m$^2$, preferably in the range of 0.2 to 0.4 g/m$^2$; the value of M.1/n for a magenta ink layer section is in the range of 0.3 to 0.8 g/m$^2$, preferably in the range of 0.3 to 0.5 g/m$^2$; and the value of M.1/n for a cyan ink layer section is in the range of 0.3 to 0.8 g/m$^2$, preferably in the range of 0.3 to 0.5 g/m.

In the above, n is the same as "n" of the n-times-speed mode method, and may be defined as the ratio of the running speed of an image formed on the image receiving sheet in the sub-scanning direction thereof to the running speed of the thermal image transfer recording medium in the sub-scanning direction thereof.

The above-mentioned n may also be defined as follows: When the length of a thermal image transfer recording medium in the subscanning direction for the formation of one picture plane is L m, and the length of a printing image in the subscanning direction for the formation of one picture plane on an image receiving sheet is R m, the value n is equal to the value of R/L.

The values of M.1/n in the respective color ink portions are in the above-mentioned respective ranges, the printing cost and the production cost of the sublimation-type thermal color image transfer recording medium can be minimized.

When the M.1/n value is smaller than in the above-mentioned respective ranges, the image density is decreased because the amount of the sublimation dye contained in the ink layer becomes too small, while when the M.1/n value thereof is larger than the above-mentioned respective ranges, the cost of the sublimation dye increases. Therefore, it is preferable that the sublimation-type thermal image transfer recording medium of the present invention have the M.1/n value in the above-mentioned range for each color ink portion.

As the materials for the support of the sublimation-type thermal color image transfer recording medium according to the present invention, condenser paper, and polyester, polystyrene, polysulfone, polyimide and polyamide films can be used.

As mentioned previously, the ink layer of the sublimation-type thermal color image transfer recording medium of the present invention comprises two layers. One is a dye-supply layer formed on the support, and the other is a dye-transfer-contribution layer formed on the dye-supply layer.

It is preferable that the dye-supply layer have a thickness in the range of 0.1 to 20 μm, and more preferably in the range of 0.5 to 10 μm. It is desirable that the dye-supply layer for a multiple-use recording medium be made thicker than that for a one-time use recording medium. In addition, it is desirable that the dye-content in the dye-supply layer be larger than that in a dye-supply layer for a one-time use recording medium. In general, the dye content in the dye-transfer layer is in the range of 5 to 80 wt. %. More specifically, it is preferable that the dye content in the dye-supply layer for use in the present invention be 0.5 to 10 g/m$^2$.

Furthermore, it is preferable that the dye-transfer-contribution layer have a thickness in the range of 0.05 to 5 μm, more preferably in the range of 0.1 to 2 μm, and that the dye content thereof be in the range of 5 to 80 wt. %, more preferably in the range of 10 to 60 wt. %. More specifically, it is preferable that the dye content in the dye-transfer-contribution layer be 0.1 to 3 g/m$^2$.

The sublimable dye contained in the dye-supply layer is generally the same as that contained in the dye-transfer-contribution layer, although different kinds of sublimable dyes with substantially the same color may be employed separately in the two layers.

It is possible to use any conventional dyes with the same color or substantially the same color which sublimate or vaporize at a temperature of 60° or more in the dye-supply layer and the dye-transfer-contribution layer.

Examples of the above-mentioned sublimable dye include disperse dyes and oil-soluble dyes which can be employed for thermal transfer textile printing.

Specific examples of such sublimable dyes include Color Index (C.I.) Disperse Yellows 1, 3, 8, 9, 16, 41, 54, 60, 77 and 116; C.I. Disperse Reds 1, 4, 6, 11, 15, 17, 55, 59, 60, 73 and 83; C.I. Disperse Blues 3, 14, 19, 26, 56, 60, 64, 72, 99 and 108; C.I. Solvent Yellows 77 and 116; C.I. Solvent Reds 23, 25 and 27; and C.I. Solvent Blues 36, 83 and 105.

These sublimable dyes can be used alone or in combination. When these sublimable dyes are used in combination, it is desirable that the mixing ratio of the dyes in the dye-supply layer be set so as to be almost the same as that in the dye-transfer-contribution layer.

As a resin binder agent for use in the ink layer for the sublimation-type thermal color image transfer recording medium of the present invention, conventionally known resins with a relatively high softening point or glass transition temperature can be preferably employed because it is necessary that the thermal color image transfer recording medium of the present invention have sufficient high resistance to heat as high temperatures applied from a thermal head for image formation.

Preferable examples of such a resin binder agent include polyvinyl chloride resin, vinyl acetate resin, polyamide, polyethylene, polycarbonate, polystyrene, polypropylene, acrylic resin, phenolic resin, polyester, polyurethane, epoxy resin, silicone resin, fluorine-contained resin, butyral resin, melamine resin, natural rubber, synthetic rubber, polyvinyl alcohol and cellulose resin.

In the present invention, it is necessary that the dye-discharging capability of the dye-supply layer be set so as to be larger than that of the dye-transfer-contribution layer.

To set the dye-discharging capability of the dye-supply layer so as to be larger than that of the dye-transfer-contribution layer, the following methods have been proposed:

(I) the concentration of the sublimable dye in the dye-supply layer is made higher than that in the dye-transfer-contribution layer and/or, (II) the diffusion coefficient of the sublimable dye in the dye-supply layer is adjusted so as to be higher than that of the sublimable dye in the dye-transfer-contribution layer.

The above-mentioned methods (I) and (II) can be employed alone or in combination. When the two methods are employed in combination, the dye-discharging capability of the dye-supply layer can be decisively made larger than that of the dye-transfer-contribution layer. The above-mentioned method (II) can be carried out as follows:

(1) The diffusion coefficient of a sublimable dye is influenced by an energetic inhibition effect against the diffusion of the sublimable dye, for example, by the hydrogen bonding between the dye and the resin binder agent in which the dye is dispersed. Therefore, for carrying out the method (II), a resin having many proton-donor groups or proton-acceptor groups, which can easily undergo the hydrogen bonding with the sublimable dye, is be used as the resin binder agent for the dye-transfer-contribution layer.

(2) The diffusion coefficient of a sublimable dye is dependent on the glass transition temperature or softening point of a resin binder agent in which the dye is dispersed. In the sublimation image transfer recording process, the lower the glass transition temperature or softening point of the binder agent in which the dye is dispersed, the higher the diffusion coefficient of the dye. Therefore, a resin binder agent with a glass transition temperature or softening point, which is lower than that of the resin binder agent contained in the dye-transfer-contribution layer, is used in the dye-supply layer.

(3) In the dye-supply layer is used a plasticizer which is compatible with at least one of resin binder agents employed in the dye-supply layer, but not compatible with any of the resin binder agents contained in the dye-transfer-contribution layer.

(4) The above-mentioned methods (1) to (3) are appropriately used in combination.

Furthermore, a method for setting the dye-discharging capability of the dye-supply layer larger than that of the dye-transfer-contribution layer is described in detail in the previously mentioned Japanese Laid-Open Patent Application 2-586.

In the present invention, in order to make the dye-discharging capability of the dye-transfer layer larger than that of the dye-transfer-contribution layer, it is preferable that the concentration of the sublimable dye in the dye-supply layer be set at 1.1 to 5 times, more preferably 1.5 to 3 times, that of the sublimable dye in the dye-transfer-contribution layer.

For attaining the above-mentioned purpose, it is also preferable that the dye-diffusion capability be made different between in the dye-supply layer and in the dye-transfer-contribution layer. For this purpose, a resin with a low softening point may be added to the resin binder agent in the dye-supply layer. This is because the diffusion coefficient of a sublimable dye, obtained by use of a resin binder agent with a low softening point, is larger than that obtained by use of a resin binder agent as described in the above method (2), and of the above-mentioned methods (1) to (4), the method (2) is most suitable for use in the present invention.

As can be seen from the above explanation, most of the binder resin agents contained in the ink layer are resins with a relatively high softening point, and when the content of resins with a low softening point in the ink layer is excessive, the mechanical strength and heat resistance of the ink layer are decreased, so that it is desirable that the mixing ratio of the resins with a low softening point in the entire resin binder agents be 50% or less except special cases, although the above-mentioned desirable mixing ratio of the resin differs depending upon the ambient conditions and transfer performance of the dye contained in the recording medium.

Preferable examples of the resin with a low softening point, which increase the diffusion coefficient of the sublimable dye in the dye-supply layer, are a variety of natural or synthetic polymeric compounds with a glass transition temperature of 0° C. or less or a softening point of 60° C. or less, such as rubbers and polymers with a low polymerizability.

Specific examples of the above-mentioned polymeric compounds, which are preferably employed in the present invention, include polyethylene oxides such as "Alkox E-30", "Alkox E-45", "Alkox R-150", "Alkox R-400" and "Alkox R-100" (Trademarks), made by Meisei Chemical Works, Ltd.; and caprolactone polyols such as "Placcel H-1", "Placcel H-4" and "Placcel H-7" (Trademarks), made by Daicel Chemical Industries, Ltd.

The ink layer for the present invention is preferably formed by a method of coating an ink layer coating liquid comprising (i) a thermoplastic resin containing active hydrogens therein serving as a resin binder agent and (ii) a crosslinking agent which easily reacts with the active hydrogens of the thermoplastic resin to form a coated ink layer, and then curing the coated ink layer by the application of heat thereto.

When the ink layer is formed by the above-mentioned method, the heat resistance and mechanical strength of the ink layer are increased, so that problems such as the break of the ink layer caused by friction, and the entire transfer of the ink layer to the image receiving sheet by the application of thermal energy thereto can be avoided. Therefore, the above method is effectively used with the n-times-speed mode method, which is usually carried out under severe conditions.

In this case, it is preferable that the amount of the crosslinking agent to tile thermoplastic resin having active hydrogens in the ink layer be in the range of 10 to 200 wt. %, more preferably in the range of 50 to 100 wt. %.

Furthermore, it is desirable that the amount of the crosslinking resin be larger in the dye-supply layer than in the dye-transfer-contribution layer.

By the provision of such an ink layer, the heat resistance and dye diffusion coefficient of the dye-transfer layer, which is to be placed under severe conditions, are increased, and the mechanical strength of the dye-supply layer which has been weakened by the addition of the resin with the low softening point is improved.

Examples of the thermoplastic resin containing active hydrogens to be added to the resin binder agent in the ink layer are butyral resin, polyvinyl formal resin, acryl polyol resin, and cellulose derivatives. Of these, butyral resin is preferably employed in the present invention.

Examples of the crosslinking resin include diisocyanates such as 2,4-tolylene diisocyanate, 2,6-tolylene diisocyanate, 4,4'-diphenylmethane diisocyanate, hexamethylene diisocyanate, xylylene diisocyanate, isophorone diisocyanate, bisisocyanate methylcyclohexane and trimethylhexamethylene diisocyanate; triisocyanates such as triphenylmethane triisocyanate; phenolic resin; epoxy resin; dialdehyde and dialdehyde derivatives. Of these, diisocyanates and triisocyanates are preferably employed.

The conditions under which the sublimable dye exits in the dye-supply layer and in the dye-transfer-contribution layer are also extremely important in the present invention.

This is because the dye-transfer layer has a function of supplying the sublimable dye constantly in a stable manner for an extended period of time and the dye-transfer-contribution layer has a function of forming high quality images uniformly without causing uneven transferred image densities on an image receiving sheet. In view of these functions of the dye-transfer layer and the dye-transfer-contribution layer, it is desirable that at least part of the sublimable dye contained in the dye-supply layer be in the state of undissolved particles, and that the sublimable dye in the dye-transfer-contribution layer exist in a monomolecular form for easy sublimation of the dye when heated.

The above-mentioned state of undissolved particles of the sublimable dye contained in the dye-supply layer means such a state that when a coating liquid for providing the dye-supply layer, which comprises a resin binder agent, a sublimable dye and a solvent, is coated on a support and dried, the sublimable dye is in the form of particles without being dissolved in the resin binder agent even after drying the coating liquid.

The separating state of the sublimable dye in the dye-supply layer varies depending on the kind of a solvent employed in the coating liquid, even though the same resin binder agent and the same sublimable dye are employed.

The presence of a sublimable dye, which is separated out in the form of particles in the dye-supply layer, can be easily recognized by an electron microscope after the formation of the dye-supply layer.

The particle diameter of the sublimable dye, which varies depending upon the thickness of the dye-supply layer, is generally in the range of 0.01 to 20 μm, and preferably in the range of 1.0 to 5 μm.

The performance of the sublimation-type thermal image transfer recording medium according to the present invention can be improved when a low-dyeable resin layer is overlaid on the dye-transfer-contribution layer as a constituent of the ink layer in the recording medium. This low-dyeable resin layer is a surface layer which is effective for preventing the formation of ghost images which are apt to be produced when colors are overlaid.

It is preferable that the low-dyeable resin layer be as thin as 0.1 to 2 μm in the present invention.

It is not necessarily contain the sublimable dye in the thin low-dyeable resin layer because this layer is very thin and has low dyeing capability. However, in the case where the sublimable dye is contained in the low-dyeable resin layer, it is preferable that the content of the sublimable dye therein be 1 $g/m^2$ or less, and 1/5 or less of the entire amount of the sublimable dyes contained in the sublimation-type thermal image transfer recording medium of the present invention.

Moreover, when the ink layer for use in the present invention is composed of three layers, that is, the above-mentioned dye-supply layer, dye-transfer-contribution layer, and low-dyeable resin layer, the amount of the sublimable dye contained in the low-dyeable resin layer should be included in the previously mentioned M, which indicates the entire amount of the sublimable dyes in the ink layer.

It is preferable that the existing conditions for the sublimable dye in the low-dyeable resin layer be set in the same conditions as those for the sublimable dye in the dye-transfer-contribution layer.

When the sublimation-type color image transfer recording medium according to the present invention comprises the above-mentioned low-dyeable resin layer on top of the recording medium and is used under the n-times-speed mode, a lubricant may be contained in the low-dyeable resin layer.

Specific examples of the lubricant for use in the low-dyeable resin layer include the following varieties of materials, compounds and mixtures: petroleum lubricating oils such as liquid paraffin; silicone oil; synthetic lubricating oils such as fluorine-contained silicone oil; a variety of modified silicone oils such as epoxy-modified silicone oil, amino-modified silicone oil, alkyl-modified silicone oil and polyether-modified silicone oil; silicone-based lubricating polymers, for example, a copolymer of an organic compound such as polyoxyalkyleneglycol and silicone; fluorine-contained surface active agents; fluorine-contained lubricants; waxes such as paraffin wax and polyethylene wax; amides of higher fatty acids; esters of higher fatty acids; salts of higher fatty acids; and hydrolyzed products obtained by use of a silane coupling agent.

Among these lubricants to be contained in the low-dyeable resin layer, the hydrolyzed products obtained by use of a silane coupling agent is most suitable for use in the low-dyeable resin layer because such hydrolyzed products not only contribute to the improvement of the heat resistance and lubricating properties of the low-dyeable resin, but also have a capability to lower the dyeing capability of the resin contained in the low-dyeable resin layer.

It is preferable that the amount of the lubricant to be added to the low-dyeable resin layer be 5 to 30 wt. % of the total weight of the low-dyeable resin layer. When the amount of the lubricant contained in the low-dyeable resin layer is in the above-mentioned range, the lubricating properties of the recording medium are satisfactorily manifested, the preservability thereof is not lowered, and the tailing phenomenon caused by the provision of the low-dyeable resin layer can be effectively prevented.

It is obviously preferable that a resin binder agent for use in the low-dyeable resin layer have a low binding affinity for a sublimable dye.

The binding affinity of the resin binder agent for a sublimable dye in the low-dyeable resin layer may be evaluated by thermally transferring a sublimable dye contained in the recording medium to an image receiving sheet comprising an image receiving layer which comprises as a the main component a resin binder agent to be evaluated. Then the density of the thus transferred image is measured. More specifically, the above-mentioned evaluation is carried out as follows:

A solution of a resin binder agent (test material) with a concentration of 5 to 20 wt. % dissolved in a volatile solvent is mixed with a mixture of commercially available modified silicone oils "SF8411" and "SF8427" (Trademarks), made by Dow Corning Toray Silicone Co., Ltd., at a mixing ratio of 1:1, in an amount corresponding to 30 wt. % of the amount of the resin binder agent in the above-mentioned solution of the resin binder agent, whereby a coating liquid for an image receiving layer is obtained.

The thus obtained coating liquid is coated on a sheet of commercially available synthetic paper "Yupo FPG#95" (Trademark), made by Oji-Yuka Synthetic Paper Co., Ltd., serving as a support, and dried at 70° C. for one minute and at room temperature for one day or more, under which conditions the volatile solvent is completely removed, so that an image receiving layer with a thickness of 10 μm on a dry basis is formed on the support. Thus, an image receiving sheet is prepared.

A commercially available color sheet for Mitsubishi color video copy processor "SCT-CP200" (Trademark), that is, a sublimation-type thermal image transfer cyan ink ribbon, is overlaid on the above-prepared image receiving sheet. Then, thermal image transfer is conducted with the application of a thermal energy of 2.00 Mj/dot to the sublimation-type thermal image transfer ink ribbon by using a commercially available thermal head "KMT-85-6MPD4" (Trademark), made by Kyocera Corp., with a resolution of 6 dots/mm and an average resistivity of 542 Ω.

The density of the image thus transferred to the image receiving sheet is measured by a Mcbeth reflection-type densitometer RD-918. As a result, in the case where the density of the image on the image receiving sheet is 1.2 or less, preferably 1.0 or less, the resin used in the image receiving layer of the image receiving sheet is considered to be suitable for a resin to be used in the low-dyeable resin layer for use in the present invention.

Specific examples of such a resin for use in the low-dyeable resin layer include an aromatic polyester resin, a styrene-butadiene resin, a polyvinyl acetate resin and a polyamide resin.

Examples of a particularly suitable resin for use in the low-dyeable resin layer include methacrylic acid ester homopolymer, methacrylic acid ester copolymer, styrene-maleic acid ester copolymer, polyimide resin, acetate resin, silicone resin, styrene-acrylonitrile resin, and polysulfone resin.

In the sublimation-type thermal image transfer recording medium according to the present invention, a conventionally known undercoat layer, which serves as an adhesive layer or the like, may be provided between the support and the dye-supply layer when necessary. Furthermore, a conventional heat-resistant protective layer or a heat-resistant lubricating layer may be provided on the back side of the support.

The sublimation-type thermal image transfer recording medium according to the present invention can be applied to other recording methods by use of recording means except a thermal head. For instance, it is possible to apply the recording medium to a recording method by use of a heat plate or a laser beam, or to a method which employs Joule's heat generated in the support or other portions of the recording medium, that is, the so-called electrothermic non-impact printing. The electrothermic non-impact printing method is widely known as described in many references, such as U.S. Pat. No. 4,103,066 and Japanese Laid-Open Patent Applications 57-14060, 57-11080 and 59-9096.

When the electrothermic non-impact printing method is employed, the following materials are used for the support of the sublimation-type thermal image transfer recording medium according to the present invention: materials which are modified to have an intermediate electric resistivity between the electric resistivities of an electroconductive material and an insulating material, for example, by dispersing at least one kind of finely-divided electroconductive particles such as finely-divided metal particles of aluminum, copper, iron, tin, zinc, nickel, molybdenum and silver and/or carbon black, in a resin having a relatively high heat resistance such as polyester, polycarbonate, triacetyl cellulose, nylon, polyimide or aromatic polyamide, or by using a support of made of any of the above-mentioned resins with any of the above-mentioned electroconductive metals deposited thereon by vacuum deposition or sputtering.

It is preferable that the thickness of the above support be in the range of approximately 2 to 15 μm when the thermal conductivity thereof for the generated Joule's heat is taken into consideration.

When laser beams are employed for image transfer, it is preferable to select a material for the support which absorbs laser beams and generates heat. For this purpose, for example, a light energy conversion agent which absorbs light and converts the light into heat, such as carbon black, may be contained in a conventional thermal image transfer film to prepare a support. Alternatively, a light-absorbing and heat-generating layer may be laminated on the front and/or back side of the support.

In the sublimation-type thermal color image transfer recording medium according to the present invention, the support may comprise a plurality of separate support members, and at least one of a yellow ink layer section, a magenta ink layer section, and a cyan ink layer section may be provided on any of the separate support members, thereby constituting a set of separate sublimation-type thermal color image transfer recording media.

More specifically, in the thermal color image transfer recording medium according to the present invention, an ink layer comprising three color portions of yellow, magenta, and cyan may be provided on one support or on more support members separately.

In the present invention, it is also possible to provide ink layers of yellow, magenta, and cyan separately on their respective three supports.

Moreover, it is possible that two supports are provided with an ink layer of a color or two color portion formed on one of the supports, and another ink layer with the other one or two color portion formed on another support. Thus, a recording medium comprising three color portion on two supports can be prepared.

Furthermore, an ink layer with three color portions may be formed on a single support as mentioned previously.

In the present invention, the term "multi-color" means colors made by use of yellow, magenta, and cyan, and nearly full-color images can be obtained by these three colors. For obtaining a complete full color image, it is desirable to add black to the above three colors, so that a sublimation-type thermal image transfer recording medium containing the sublimable dyes with four colors is preferably employed for obtaining a full color image.

The sublimation-type thermal color image transfer recording medium according to the present invention can be made in the form of a ribbon.

In this case, it is preferable that the sublimation-type thermal color image transfer recording medium be in the same shape as that of a conventional ink ribbon for forming multi-color images.

More specifically, the ribbon-shaped sublimation-type color image transfer recording medium of the present invention comprises a plurality of ink layer group sections, each of the ink layer group section comprising a yellow ink layer section, a magenta ink layer section, and a cyan ink layer section, arranged in the longitudinal direction thereof.

As mentioned previously, a thick dye-supply layer is preferable for the thermal color image transfer recording medium of the present invention. However, when the dye-supply layer is prepared by lithographic printing, intaglio printing, or relief printing, two or more coating is required to obtain a satisfactorily thick dye-supply layer, so that the cost for preparing the dye-supply layer becomes high. Therefore, it is desirable that the dye-supply layer be formed by the microgravure method, the stencil printing method, or the screen printing. In the dye-supply layer formed by the microgravure method, however, uneven coating often occurs in the leading edge portion and rear end portion of the dye-supply layer. Therefore, the stencil printing method and screen printing are most preferably employed for forming the dye-supply layer for the ribbon-shaped thermal image transfer recording medium.

In the present invention, when the ink layer comprising a yellow ink layer, a magenta ink layer and a cyan ink layer, is formed on one support, the recording medium is generally worked into a ribbon-shaped recording medium. In this case, the ink layer comprises a plurality of ink layer group sections arranged in the direction of the ribbon-shaped recording medium, and each of the ink layer group sections comprises a yellow ink layer section for the yellow ink layer, a magenta ink layer section for the magenta ink layer, and a cyan ink layer section for the cyan ink layer.

In the above ribbon-shaped recording medium, a sensor marker can be provided in a boundary area between each of the ink layer group sections, or in a boundary area between each of the yellow ink layer, the magenta ink layer and the cyan ink layer in each of the ink layer group sections.

In the case where such a sensor marker is provided in the above-mentioned boundary area between each of the yellow ink layer, the magenta ink layer and the cyan ink layer, for instance, when a thermal head has finished the printing of a certain color, the thermal head can be automatically returned to its printing start point for starting the printing of the next color to be printed, without being moved in the main scanning direction thereof.

Moreover, in the case where a sensor marker is provided in a boundary area between each of the ink layer group sections, each ink layer section comprising the yellow ink layer, the magenta ink layer and the cyan ink layer, the thermal head is automatically brought back to its printing start point for the next printing operation, with the thermal head being shifted in the main scanning direction thereof.

As is obvious from the above explanation, when sensor markers are provided in the boundary areas between each of the ink layer group sections, or in the boundary areas between each of the yellow ink layer, the magenta layer, and the cyan ink layer, the multi-color image formation can be exactly and easily carried out without overlapped color printing and color skipping.

Other features of this invention will become apparent in the course of the following description of exemplary embodiments, which are given for illustration of the invention and are not intended to be limiting thereof.

Example 1

A heat resistant protective layer made of silicone resin with a thickness of 1 μm was overlaid on an aromatic polyamide film with a thickness of 6 μm, serving as a support.

Formation of Intermediate Adhesive Layer

The following components were mixed to prepare an intermediate adhesive layer coating liquid:

| | Parts by Weight |
|---|---|
| Polyvinyl butyral resin "BX-1" (Trademark) made by Sekisui Chemical Co., Ltd. | 10 |
| Diisocyanate "Coronate L" (Trademark) made by Nippon Polyurethane Industry Co., Ltd. | 5 |
| Toluene | 95 |
| Methyl ethyl ketone | 95 |

The above-obtained intermediate adhesive layer coating liquid was coated on the support, opposite to the heat-resistant protective layer with respect to the support, by use of a wire bar, so that an intermediate adhesive layer with a thickness of 1.0 μm was provided on the support.

Preparation of Dye-supply Layer Coating Liquids and Dye-transfer-contribution Layer Coating Liquids (1) Preparation of Dye-supply Layer Coating Liquids for Yellow Ink Layer Section, Magenta Ink Layer Section, and Cyan Ink Layer Section The following components were mixed, whereby dye-supply coating liquids for a yellow ink layer section, a magenta ink layer section, and a cyan ink layer section were prepared:

| | Parts by Weight |
|---|---|
| Polyvinyl butyral resin "BX-1" (Trademark) made by Sekisui Chemical Co., Ltd. | 7 |
| Polyethylene oxide resin "R-400" (Trademark) made by Meisei Chemical Works, Ltd. | 3 |
| Diisocyanate "Coronate L" (Trademark) made by Nippon Polyurethane Industry Co., Ltd.: | |
| For Yellow Ink Layer Section | 7 |
| For Magenta Ink Layer Section | 5 |
| For Cyan Ink Layer Section | 7 |
| Sublimable dyes: | |
| For Yellow Ink Layer Section: "Yellow VP" (Trademark) made by Mitsui Toatsu Dyes, Ltd. (Y-1) | 30 |
| For Magenta Ink Layer Section: "Magenta VP" (Trademark) made by Mitsui Toatsu Dyes, Ltd. (M-3) | 30 |
| For Cyan Ink Layer Section: "Ceres Blue GN" (Trademark) made by Bayer A.G. (C-1) | 30 |
| Ethyl alcohol | 170 |
| Butyl alcohol | 20 |

(2) Preparation of Dye-transfer-contribution Layer Coating Liquids for Yellow Ink Layer Section, Magenta Ink Layer Section, and Cyan Ink Layer Section The following components were mixed, whereby dye-transfer-contribution layer coating liquids for the yellow ink layer section, the magenta ink layer section, and the cyan ink layer section were prepared:

| | Parts by Weight |
|---|---|
| Polyvinyl butyral resin "BX-1" (Trademark) made by Sekisui Chemical Co., Ltd. | 10 |
| Diisocyanate "Coronate L" (Trademark) made by Nippon Polyurethane Industry Co., Ltd.: | |
| For Yellow Ink Layer Section | 3 |
| For Magenta Ink Layer Section | 1.5 |
| For Cyan Ink Layer Section | 3 |
| Sublimable dyes: | |
| For Yellow Ink Layer Section: "Yellow VP" (Trademark) made by Mitsui Toatsu Dyes, Ltd. (Y-1) | 4 |
| For Magenta Ink Layer Section: "HM 1450" (Trademark) made by Mitsui Toatsu Dyes, Ltd. (M-2) | 10 |
| For Cyan Ink Layer Section: "Ceres Blue GN" (Trademark) made by Bayer A.G. (C-1) | 11 |
| Lubricants: | |
| Epoxy-modified silicone oil "SF8411" (Trademark) made by Dow Corning Toray silicone Co., Ltd.: | |
| For Yellow Ink Layer Section | 1.5 |
| For Magenta Ink Layer Section | 1.9 |
| For Cyan Ink Layer Section | 1.5 |
| Alcohol-modified silicone oil "SF8427" (Trademark) made by Dow Corning Toray silicone Co., Ltd.: | |
| For Yellow Ink Layer Section | 1.5 |
| For Magenta Ink Layer Section | 1.9 |
| For Cyan Ink Layer Section | 1.5 |
| Solvents: | |
| Toluene | 57 |
| Methyl ethyl ketone | 57 |

-continued

| | Parts by Weight |
|---|---|
| Dioxane | 76 |

Formation of Ink Layer

Each of the above-mentioned coating liquids for the dye-supply layers and dye-transfer-contribution layers for the yellow ink layer section, magenta ink layer section, and cyan ink layer section, were successively coated on the intermediate adhesive layer by a wire bar, dried, and then each ink layer was heated to 60° C., and the temperature was maintained for 24 hours for curing, so that each ink layer section was formed on the intermediate adhesive layer, with the following ink layer structure as shown in TABLE 1, whereby a sublimation-type thermal color image transfer recording medium No. 1 according to the present invention was fabricated:

TABLE 1

| Color Ink Layer Section | Ink Layers | Thickness (μm) | Content of Dye (g/m²) |
|---|---|---|---|
| Yellow Ink Layer Section | Dye-supply Layer | 5.5 | 3.0 |
| | Dye-transfer-Contribution Layer | 1.0 | 1.3 |
| Magenta Ink Layer Section | Dye-supply Layer | 7.0 | 3.0 |
| | Dye-transfer-Contribution Layer | 2.0 | 1.1 |
| Cyan Ink Layer Section | Dye-supply Layer | 5.5 | 3.0 |
| | Dye-transfer-Contribution Layer | 2.0 | 1.1 |

In the above sublimation-type thermal color image transfer recording medium No. 1 according to the present invention, the previously defined values M, L, R and M.L/R for the respective ink portions are as shown in the following TABLE 2:

TABLE 2

| Color Ink Layer Section | Dye | M (g/m²) | L (× $10^{-2}$m) | R (× $10^{-2}$m) | M · L/R (g/m²) |
|---|---|---|---|---|---|
| Yellow Ink Layer Section | Y-1 | 4.3 | 2.8 | 28.5 | 0.42 |
| Magenta Ink Layer Section | (M-2) + (M-3) | 4.1 | 4.1 | 28.5 | 0.59 |
| Cyan Ink Layer Section | C-1 | 4.1 | 4.1 | 28.5 | 0.59 |

The following TABLE 3 is a list of the dyes employed in the above Example 1, and those in Examples 2 to 8 of the present invention and Comparative Examples 1 to 8, which will now be explained. This list particularly shows the abbreviation of each dye and the manufacture thereof:

TABLE 3

| Color | Dye (Symbol) | | Manufacturer |
|---|---|---|---|
| Yellow | Yellow VP | (Y-1) | Mitsui Toatsu Dyes, Ltd. |
| | Foron Brilliant Yellow S 6GL | (Y-2) | Sandoz K.K. |
| | Macrolex Yellow 6G | (Y-3) | Bayer A.G. |
| Magenta | HM 1041 | (M-1) | Mitsui Toatsu Dyes, Ltd. |
| | HM 1450 | (M-2) | Mitsui Toatsu Dyes, Ltd. |
| | Magenta VP | (M-3) | Mitsui Toatsu Dyes, Ltd. |
| | Macrolex Red Violet R | (M-4) | Bayer A.G. |
| Cyan | Ceres Blue GN | (C-1) | Bayer A.G. |
| | HSO 144 | (C-2) | Mitsui Toatsu Dyes, Ltd. |
| | Foron Brilliant Blue SR | (C-3) | Sandoz K.K. |

Examples 2–4 and Comparative Examples 1 and 2

The procedure for fabrication of the sublimation-type thermal color image transfer recording medium No. 1 of the present invention in Example 1 was repeated except that the values of L, R and M.L/R were changed as shown in the following TABLE 4, whereby sublimation-type thermal color image transfer recording media No. 2 to No. 4 according to the present invention and comparative sublimation-type thermal color image transfer recording media No. 1 and No. 2 were fabricated:

TABLE 4

| Ex. | Color Ink Layer Section | Dye | M (g/m²) | L (× 10⁻²) | R (× 10⁻²) | M · L/R (g/m²) |
|---|---|---|---|---|---|---|
| Ex. 2 | Yellow Ink Layer Section | Y-1 | 4.3 | 1.4 | 28.5 | 0.21 |
| | Magenta Ink Layer Section | (M-2) + (M-3) | 4.1 | 4.1 | 28.5 | 0.59 |
| | Cyan Ink Layer Section | C-1 | 4.1 | 4.1 | 28.5 | 0.59 |
| Ex. 3 | Yellow Ink Layer Section | Y-1 | 4.3 | 2.8 | 28.5 | 0.42 |
| | Magenta Ink Layer Section | (M-2) + (M-3) | 4.1 | 2.8 | 28.5 | 0.40 |
| | Cyan Ink Layer Section | C-1 | 4.1 | 4.1 | 28.5 | 0.59 |
| Ex. 4 | Yellow Ink Layer Section | Y-1 | 4.3 | 2.8 | 28.5 | 0.42 |
| | Magenta Ink Layer Section | (M-2) + (M-3) | 4.1 | 4.1 | 28.5 | 0.59 |
| | Cyan Ink Layer Section | C-1 | 4.1 | 2.8 | 28.5 | 0.40 |
| Comp. Ex. 1 | Yellow Ink Layer Section | Y-1 | 4.3 | 0.7 | 28.5 | 0.11 |
| | Magenta Ink Layer Section | (M-2) + (M-3) | 4.1 | 1.4 | 28.5 | 0.20 |
| | Cyan Ink Layer Section | C-1 | 4.1 | 1.4 | 28.5 | 0.20 |
| Comp. Ex. 2 | Yellow Ink Layer Section | Y-1 | 4.3 | 4.1 | 28.5 | 0.62 |
| | Magenta Ink Layer Section | (M-2) + (M-3) | 4.1 | 5.7 | 28.5 | 0.82 |
| | Cyan Ink Layer Section | C-1 | 4.1 | 5.7 | 28.5 | 0.82 |

Example 5

A heat resistant protective layer made of silicone resin with a thickness of 1 μm was overlaid on an aromatic polyamide film with a thickness of 6 μm, serving as a support.

Formation of Intermediate Adhesive Layer

The following components were mixed to prepare an intermediate adhesive layer coating liquid:

| | Parts by Weight |
|---|---|
| Polyvinyl butyral resin "BX-1" (Trademark) made by Sekisui Chemical Co., Ltd. | 10 |
| Diisocyanate "Coronate L" (Trademark) made by Nippon Polyurethane Industry Co., Ltd. | 5 |
| Toluene | 95 |
| Methyl ethyl ketone | 95 |

The above-obtained intermediate adhesive layer coating liquid was coated on the support, opposite to the heat-resistant protective layer with respect to the support, by use of a wire bar, so that an intermediate adhesive layer with a thickness of 1.0 μm was provided on the support.

Preparation of Dye-supply Layer Coating Liquids and Dye-transfer-contribution Layer Coating Liquids (1) Preparation of Dye-supply Layer Coating Liquids for Yellow Ink Layer Section, Magenta Ink Layer Section, and Cyan Ink Layer Section The following components were mixed, whereby dye-supply layer coating liquids for a yellow ink layer section, a magenta ink layer section, and a cyan ink layer section were prepared:

| | Parts by Weight |
|---|---|
| Polyvinyl butyral resin "BX-1" (Trademark) made by Sekisui Chemical Co., Ltd. | 7 |
| Polyethylene oxide resin "R-400" (Trademark) made by Meisei Chemical Works, Ltd. | 3 |
| Diisocyanate "Coronate L" (Trademark) made by Nippon Polyurethane Industry Co., Ltd.: | |
| For Yellow Ink Layer Section | 5 |
| For Magenta Ink Layer Section | 5 |
| For Cyan Ink Layer Section | 5 |
| Sublimable dyes: | |
| For Yellow Ink Layer Section: | |

-continued

| | Parts by Weight |
|---|---|
| "Foron Brilliant Yellow S 6GL" (Trademark) made by Sandoz K.K. (Y-2) | 28 |
| "Macrolex Yellow 6G" (Trademark) made by Bayer A.G. (Y-3) | 7 |
| For Magenta Ink Layer Section: | |
| "HM 1041" (Trademark) made by Mitsui Toatsu Dyes, Ltd. (M-1) | 14 |
| "Macrolex Red Violet R" (Trademark) made by Bayer A.G. (M-4) | 25 |
| For Cyan Ink Layer Section: | |
| "HSO 144" (Trademark) made by Mitsui Toatsu Dyes, Ltd. (C-2) | 28 |
| "Foron Brilliant Blue SR" (Trademark) made by Sandoz K.K. (C-3) | 7 |
| Ethyl alcohol | 170 |
| Butyl alcohol | 20 |

(2) Preparation of Dye-transfer-contribution Layer Coating Liquids for Yellow Ink Layer Section, Magenta Ink Layer Section, and Cyan Ink Layer Section The following components were mixed, whereby dye-transfer-contribution layer coating liquids for the yellow ink layer section, the magenta ink layer section, and the cyan ink layer section were prepared:

| | Parts by Weight |
|---|---|
| Polyvinyl butyral resin "BX-1" (Trademark) made by Sekisui Chemical Co., Ltd. | 10 |
| Diisocyanate "Coronate L" (Trademark) made by Nippon Polyurethane Industry Co., Ltd.: | |
| For Yellow Ink Layer Section | 3 |
| For Magenta Ink Layer Section | 3 |
| For Cyan Ink Layer Section | 3 |
| Sublimable dyes: | |
| For Yellow Ink Layer Section | |
| (Y-2) | 16 |
| (Y-3) | 4 |
| For Magenta Ink Layer Section | |
| (M-1) | 8 |
| (M-4) | 12 |
| For Cyan Ink Layer Section | |
| (C-2) | 16 |
| (C-3) | 4 |
| Solvents: | |
| Toluene | 57 |
| Methyl ethyl ketone | 57 |
| Dioxane | 76 |

(3) Preparation of Low-dyeable Resin Layer Coating Liquid

A low-dyeable resin layer coating liquid was prepared by mixing the following components:

| | Parts by Weight |
|---|---|
| Styrene-maleic acid ester copolymer "Suprapal AP301" (Trademark) made by BASF Japan Ltd. | 5 |
| Liquid G | 12 |
| Sublimable dyes: | |
| For Yellow Ink Layer Section: | |
| (Y-2) | 3.2 |
| (Y-3) | 0.8 |
| For Magenta Ink Layer Section: | |
| (M-1) | 2 |
| (M-4) | 3 |

-continued

| | Parts by Weight |
|---|---|
| For Cyan Ink Layer Section: | |
| (C-2) | 3.2 |
| (C-3) | 0.8 |

The above-mentioned Liquid G to be contained in the low-dyeable resin layer is a hydrolyzed product of a silane coupling agent used as a lubrication-imparting agent, and was prepared as follows:

15 parts by weight of dimethylmethoxy silane and 9 parts by weight of methyltrimethoxy silane were dissolved in a mixed solvent consisting of 12 parts by weight of toluene and 12 parts by weight of methyl ethyl ketone. With the addition of 13.3 parts by weight of 3% sulfuric acid to the above solution, the mixture was hydrolyzed for 3 hours, whereby the Liquid G was obtained.

Formation of Ink Layer

Each of the above-mentioned coating liquids for the dye-supply layers and dye-transfer-contribution layers for the yellow ink layer section, magenta ink layer section, and cyan ink layer section, and the low-dyeable resin layer coating liquid were successively coated on the intermediated adhesive layer by a wire bar, dried, and then each ink layer was heated to 60° C., and the temperature was maintained for 24 hours for curing, so that each ink layer section was formed on the intermediate adhesive layer, with the following ink layer structure as shown in TABLE 5, whereby a sublimation-type thermal color image transfer recording medium No. 5 according to the present invention was fabricated:

TABLE 5

| Color Ink Layer Section | Ink Layers | Thickness (μm) | Content of Dye (g/m²) |
|---|---|---|---|
| Yellow Ink Layer Section | Dye-supply layer | 6.0 | 3.3 |
| | Dye-transfer-contribution layer | 2.0 | 1.2 |
| | Low-dyeable resin layer | 1.0 | 0.1 |
| Magenta Ink Layer Section | Dye-supply layer | 7.5 | 4.5 |
| | Dye-transfer-contribution layer | 2.5 | 1.3 |
| | Low-dyeable resin layer | 1.0 | 0.5 |
| Cyan Ink Layer Section | Dye-supply layer | 6.0 | 4.8 |
| | Dye-transfer-contribution layer | 3.0 | 2.4 |
| | Low-dyeable resin layer | 1.0 | 0.5 |

In the above sublimation-type thermal color image transfer recording medium No. 5 according to the present invention, the previously defined values M, L, and M.L/R for the respective ink portions are as shown in the following TABLE 6.

TABLE 6

| Color Ink Layer Section | Dye | M (g/m²) | L (× $10^{-2}$m) | R (× $10^{-2}$m) | M · L/R (g/m²) |
|---|---|---|---|---|---|
| Yellow Ink | (Y-2) + (Y-3) | 4.6 | 1.6 | 28.5 | 0.26 |

TABLE 6-continued

| Color Ink Layer Section | Dye | M ($g/m^2$) | L ($\times 10^{-2}m$) | R ($\times 10^{-2}m$) | M · L/R ($g/m^2$) |
|---|---|---|---|---|---|
| Layer Section | | | | | |
| Magenta Ink Layer Section | (M-1) + (M-4) | 6.3 | 1.9 | 28.5 | 0.42 |
| Cyan Ink Layer Section | (C-2) + (C-3) | 7.7 | 1.6 | 28.5 | 0.43 |

Comparative Examples 3 and 4

The procedure for fabrication of the sublimation-type thermal color image transfer recording medium No. 5 of the present invention in Example 5 was repeated except that the values of L, R and M.L/R were changed as shown in the following TABLE 7, whereby comparative sublimation-type thermal color image transfer recording media No. 3 and No. 4 were fabricated:

TABLE 7

| Comp. Ex. | Color Ink Layer Section | Dye | M ($g/m^2$) | L ($\times 10^{-2}$) | R ($\times 10^{-2}$) | M · L/R ($g/m^2$) |
|---|---|---|---|---|---|---|
| Comp. Ex. 3 | Yellow Ink Layer Section | (Y-2) + (Y-3) | 4.6 | 1.0 | 28.5 | 0.16 |
| | Magenta Ink Layer Section | (M-1) + (M-4) | 6.3 | 1.0 | 28.5 | 0.22 |
| | Cyan Ink Layer Section | (C-2) + (C-3) | 7.7 | 1.0 | 28.5 | 0.27 |
| Comp. Ex. 4 | Yellow Ink Layer Section | (Y-2) + (Y-3) | 4.6 | 4.1 | 28.5 | 0.66 |
| | Magenta Ink Layer Section | (M-1) + (M-4) | 6.3 | 4.1 | 28.5 | 0.91 |
| | Cyan Ink Layer Section | (C-2) + (C-3) | 7.7 | 4.1 | 28.5 | 1.10 |

Example 6

A long ribbon-shaped support with a width of 200 mm was made by use of exactly the same material for the support as that employed in Example 1, provided with the same heat-resistant protective layer and intermediate adhesive layer as those provided on the support employed in Example 1 in the same manner as in Example 1.

On this ribbon-shaped support, the same intermediate adhesive layer as that employed in Example 1 was provided in the same manner as in Example 1.

Preparation of Dye-supply Layer Coating Liquids and Dye-transfer-contribution Layer Coating Liquids (1) Preparation of Dye-supply Layer Coating Liquids for Yellow Ink Layer Section, Magenta Ink Layer Section, and Cyan Ink Layer Section The following components were mixed, whereby dye-supply layer coating liquids for a yellow ink layer section, a magenta ink layer section, and a cyan ink layer section were prepared:

| | Parts by Weight |
|---|---|
| Polyvinyl butyral resin "BX-1" (Trademark) made by Sekisui Chemical Co., Ltd. | 7 |
| Polyethylene oxide resin "R-400" (Trademark) made by Meisei Chemical Works, Ltd. | 3 |
| Diisocyanate "Coronate L" (Trademark) made by Nippon Polyurethane Industry Co., Ltd.: | |
| For Yellow Ink Layer Section | 7 |
| For Magenta Ink Layer Section | 5 |
| For Cyan Ink Layer Section | 7 |
| Sublimable dyes: | |
| For Yellow Ink Layer Section: "Yellow VP" (Trademark) made by Mitsui Toatsu Dyes, Ltd. (Y-1) | 30 |
| For Magenta Ink Layer Section: "Magenta VP " (Trademark) made by Mitsui Toatsu Dyes, Ltd. (M-3) | 30 |
| For Cyan Ink Layer Section: "Ceres Blue GN" (Trademark) made by Bayer A.G. (C-1) | 30 |
| Butyl alcohol | 133 |

(2) Preparation of Dye-transfer-contribution Layer Coating Liquids for Yellow Ink Layer Section, Magenta Ink Layer Section, and Cyan Ink Layer Section The following components were mixed, whereby dye-transfer-contribution layer coating liquids for the yellow ink layer section, the magenta ink layer section, and the cyan ink layer section were prepared:

| | Parts by Weight |
|---|---|
| Polyvinyl butyral resin "BX-1" (Trademark) made by Sekisui Chemical Co., Ltd. | 10 |
| Diisocyanate "Coronate L" (Trademark) made by Nippon Polyurethane Industry Co., Ltd.: | |
| For Yellow Ink Layer Section | 3 |
| For Magenta Ink Layer Section | 1.5 |
| For Cyan Ink Layer Section | 3 |
| Sublimable dyes: | |
| For Yellow Ink Layer Section: "Yellow VP" (Trademark) made by Mitsui Toatsu Dyes, Ltd. (Y-1) | 4 |
| For Magenta Ink Layer Section: "HM 1450" (Trademark) made by Mitsui Toatsu Dyes, Ltd. (M-2) | 10 |
| For Cyan Ink Layer Section: "Ceres Blue GN" (Trademark) made by Bayer A.G. (C-1) | 11 |
| Lubricants: | |
| Epoxy-modified silicone oil "SF8411" (Trademark) made by Dow Corning Toray silicone Co., Ltd.: | 1.5 |
| For Yellow Ink Layer Section | 1.5 |
| For Magenta Ink Layer Section | 1.9 |
| For Cyan Ink Layer Section | 1.5 |
| Alcohol-modified silicone oil "SF8427" (Trademark) made by Dow Corning Toray silicone Co., Ltd.: | |
| For Yellow Ink Layer Section | 1.5 |
| For Magenta Ink Layer Section | 1.9 |
| For Cyan Ink Layer Section | 1.5 |
| Solvent: | |
| Cyclohexanone | 133 |

Formation of Ink Layer

Each of the above-mentioned coating liquids for the dye-supply layers and dye-transfer-contribution layers for the yellow ink layer section, magenta ink layer section, and cyan ink layer section, were successively coated on "the intermediate adhesive layer by a screen printing method using a screen of 150 meshes/inch for the dye-supply layers, and using a screen of 300 meshes-/inch for the dye-transfer-contribution layers, and dried.

Each ink layer was then heated to 60° C., and the temperature was maintained for 24 hours for curing, so that ink layer group sections were formed on the intermediate adhesive layer, with the following ink layer structure as shown in TABLES 8 and 9.

TABLE 8 shows the thickness of each of the dye-supply layers for the ink layer section, magenta layer section, and cyan ink layer section, and the contents of the respective sublimable dyes therein; and the thickness of each of the dye-transfer-contribution layers for the ink layer section, magenta layer section, and cyan ink layer section, and the contents of the respective sublimable dyes therein.

These ink layer group sections were arranged in the longitudinal direction of the ribbon-shaped support, and each ink layer group section included the yellow ink layer section, the magenta ink layer section, and the cyan ink layer section in this order.

The length of each ink layer section set so as to correspond to a length of the respective L in TABLE 9 plus 5 mm for a margin.

Furthermore, a sensor marker was provided in a boundary area between each ink layer section, specifically at a rear end portion of each cyan ink layer section (i.e. in a boundary area immediately before each yellow ink layer section). Thus, a sublimation-type thermal color image transfer recording medium was fabricated, which is referred to as sublimation-type thermal color image transfer recording medium No. 6A according to the present invention.

Furthermore, another sublimation-type thermal color image transfer recording medium was fabricated in exactly the same manner as in the case of sublimation-type thermal color image transfer recording medium No. 6A except that the sensor marker was provided between each ink layer section. The thus fabricated recording medium is referred to as sublimation-type thermal color image transfer recording medium No. 6B according to the present invention.

TABLE 8

| Color Ink Layer Section | Ink Layers | Thickness (μm) | Content of Dye (g/m²) |
|---|---|---|---|
| Yellow Ink Layer Section | Dye-supply Layer | 5.5 | 3.0 |
| | Dye-transfer-Contribution Layer | 1.0 | 1.3 |
| Magenta Ink Layer Section | Dye-supply Layer | 7.0 | 3.0 |
| | Dye-transfer-Contribution Layer | 2.0 | 1.1 |
| Cyan Ink Layer Section | Dye-supply Layer | 5.5 | 3.0 |
| | Dye-transfer-Contribution Layer | 2.0 | 1.1 |

In the above sublimation-type thermal color image transfer recording medium No. 6 according to the present invention, the previously defined values M, L, R and M.L/R for the respective ink portions are as shown in the following TABLE 9:

TABLE 9

| Color Ink Layer Section | Dye | M (g/m²) | L (× $10^{-2}$ m) | R (× $10^{-2}$ m) | M · L/R (g/m²) |
|---|---|---|---|---|---|
| Yellow Ink Layer Section | Y-1 | 4.3 | 2.8 | 28.5 | 0.42 |
| Magenta Ink Layer Section | (M-2) + (M-3) | 4.1 | 4.1 | 28.5 | 0.59 |
| Cyan Ink Layer Section | C-1 | 4.1 | 4.1 | 28.5 | 0.59 |

Example 7 and Comparative Examples 5 and 6

The procedure for fabrication of the sublimation-type thermal color image transfer recording medium No. 6 of the present invention was repeated except that the values of L, R and M.L/R were changed as shown in the following TABLE 10, whereby sublimation-type thermal color image transfer recording medium No. 7 according to the present invention and comparative sublimation-type thermal color image transfer recording media No. 5 and No. 6 were fabricated:

TABLE 10

| Ex. | Color Ink Layer Section | Dye | M (g/m²) | L (× $10^{-2}$) | R (× $10^{-2}$) | M · L/R (g/m²) |
|---|---|---|---|---|---|---|
| Ex. 7 | Yellow Ink Layer Section | Y-1 | 4.3 | 1.4 | 28.5 | 0.21 |
| | Magenta Ink Layer Section | (M-2) + (M-3) | 4.1 | 2.8 | 28.5 | 0.40 |
| | Cyan Ink Layer Section | C-1 | 4.1 | 2.8 | 28.5 | 0.40 |
| Comp. Ex. 5 | Yellow Ink Layer Section | Y-1 | 4.3 | 0.7 | 28.5 | 0.11 |
| | Magenta Ink Layer Section | (M-2) + (M-3) | 4.1 | 1.4 | 28.5 | 0.20 |
| | Cyan Ink | C-1 | 4.1 | 1.4 | 28.5 | 0.20 |

TABLE 10-continued

| Ex. | Color Ink Layer Section | Dye | M ($g/m^2$) | L ($\times 10^{-2}$) | R ($\times 10^{-2}$) | M · L/R ($g/m^2$) |
|---|---|---|---|---|---|---|
| | Layer Section | | | | | |
| Comp. Ex. 6 | Yellow Ink Layer Section | Y-1 | 4.3 | 4.1 | 28.5 | 0.62 |
| | Magenta Ink Layer Section | (M-2) + (M-3) | 4.1 | 5.7 | 28.5 | 0.82 |
| | Cyan Ink Layer Section | C-1 | 4.1 | 5.7 | 28.5 | 0.82 |

Example 8

On the same ribbon-shaped support as that employed in Example 6, the same intermediate adhesive layer as that employed in Example 1 was provided in the same manner as in Example 1.

Preparation of Dye-supply Layer Coating Liquids and Dye-transfer-contribution Layer Coating Liquids (1) Preparation of Dye-supply Layer Coating Liquids for Yellow Ink Layer Section, Magenta Ink Layer Section, and Cyan Ink Layer Section The following components were mixed, whereby dye-supply layer coating liquids for a yellow ink layer section, a magenta ink layer section, and a cyan ink layer section were prepared:

| | Parts by Weight |
|---|---|
| Polyvinyl butyral resin "BX-1" (Trademark) made by Sekisui Chemical Co., Ltd. | 7 |
| Polyethylene oxide resin "R-400" (Trademark) made by Meisei Chemical Works, Ltd. | 3 |
| Diisocyanate "Coronate L" (Trademark) made by Nippon Polyurethane Industry Co., Ltd.: | |
| For Yellow Ink Layer Section | 5 |
| For Magenta Ink Layer Section | 5 |
| For Cyan Ink Layer Section | 5 |
| Sublimable dyes: | |
| For Yellow Ink Layer Section: | |
| "Foron Brilliant Yellow S 6GL" (Trademark" made by Sandoz K.K. (Y-2) | 28 |
| "Macrolex Yellow 6G" (Trademark" made by Bayer A.G. (Y-3) | 7 |
| For Magenta Ink Layer Section: | |
| "HM 1041" (Trademark) made by Mitsui Toatsu Dyes, Ltd. (M-1) | 14 |
| "Macrolex Red Violet R" made by Bayer A.G. (M-4) | 25 |
| For Cyan Ink Layer Section: | |
| "HSO 144" (Trademark) made by Mitsui Toatsu Dyes, Ltd. (C-2) | 28 |
| "Foron Brilliant Blue SR" (Trademark) made by Sandoz K.K. (C-3) | 7 |
| Solvent: | |
| Butyl alcohol | 133 |

(2) Preparation of Dye-transfer-contribution Layer Coating Liquids for Yellow Ink Layer Section, Magenta Ink Layer Section, and Cyan Ink Layer Section The following components were mixed, whereby dye-transfer-contribution layer coating liquids for a yellow ink layer section, a magenta ink layer section, and a cyan ink layer section were prepared:

| | Parts by Weight |
|---|---|
| Polyvinyl butyral resin "BX-1" (Trademark) made by Sekisui Chemical Co., Ltd. | 10 |
| Diisocyanate "Coronate L" (Trademark) made by Nippon Polyurethane Industry Co., Ltd.: | |
| For Yellow Ink Layer Section | 3 |
| For Magenta Ink Layer Section | 3 |
| For Cyan Ink Layer Section | 3 |
| Sublimable dyes: | |
| For Yellow Ink Layer Section: | |
| (Y-2) | 16 |
| (Y-3) | 4 |
| For Magenta Ink Layer Section: | |
| (M-1) | 8 |
| (M-4) | 12 |
| For Cyan Ink Layer Section: | |
| (C-2) | 16 |
| (C-3) | 4 |
| Solvent: | |
| Cyclohexanone | 133 |

(3) Preparation of Low-dyeable Resin Layer Coating Liquid

A low-dyeable resin layer coating liquid was prepared by mixing the following components:

| | Parts by Weight |
|---|---|
| Styrene-maleic acid ester copolymer "Suprapal AP30" (Trademark) made by BASF Japan Ltd. | 5 |
| Liquid G (the same as that employed in Example 5) | 12 |
| Sublimable dyes: | |
| For Yellow Ink Layer Section: | |
| (Y-2) | 3.2 |
| (Y-3) | 0.8 |
| For Magenta Ink Layer Section: | |
| (M-1) | 2 |
| (M-4) | 3 |
| For Cyan Ink Layer Section: | |
| (C-2) | 3.2 |
| (C-3) | 0.8 |

Formation of Ink Layer

Each of the above-mentioned coating liquids for the dye-supply layers and dye-transfer-contribution layers for the yellow ink layer section, magenta ink layer section, and cyan ink layer section, and the low-dyeable resin layer coating liquid were successively coated on the intermediated adhesive layer by a wire bar, dried, and then each ink layer was heated to 60° C., and the temperature was maintained for 24 hours for curing, so that each ink layer section was formed on the intermediate adhesive layer, with the following ink layer structure as shown in TABLE 11, whereby sublimation-type thermal color image transfer recording medium No. 8 according to the present invention was fabricated:

TABLE 11

| Color Ink Layer Section | Ink Layers | Thickness (μm) | Content of Dye ($g/m^2$) |
|---|---|---|---|
| Yellow Ink Layer Section | Dye-supply layer | 6.0 | 3.3 |
| | Dye-transfer-contribution layer | 2.0 | 1.2 |
| | Low-dyeable resin layer | 1.0 | 0.1 |
| Magenta Ink Portion | Dye-supply layer | 7.5 | 4.5 |
| | Dye-transfer-contribution layer | 2.5 | 1.3 |
| | Low-dyeable resin layer | 1.0 | 0.5 |
| Cyan Ink Layer Section | Dye-supply layer | 6.0 | 4.8 |
| | Dye-transfer-contribution layer | 3.0 | 2.4 |
| | Low-dyeable resin layer | 1.0 | 0.5 |

In the above sublimation-type thermal color image transfer recording medium No. 8 according to the present invention, the previously defined values M, L, and M.L/R for the respective ink portions are as shown in the following TABLE 12.

TABLE 12

| Color Ink Layer Section | Dye | M ($g/m^2$) | L ($\times 10^{-2}$ m) | R ($\times 10^{-2}$ m) | M · L/R ($g/m^2$) |
|---|---|---|---|---|---|
| Yellow Ink Layer Section | (Y-2) + (Y-3) | 4.6 | 1.6 | 28.5 | 0.26 |
| Magenta Ink Layer Section | (M-1) + (M-4) | 6.3 | 1.9 | 28.5 | 0.42 |
| Cyan Ink Layer Section | (C-2) + (C-3) | 7.7 | 1.6 | 28.5 | 0.43 |

TABLE 12-continued

In order to evaluate sublimation type thermal image transfer recording media Nos. 1 to 8 according to the present invention and comparative thermal image transfer recording media Nos. 1 to 8, an image receiving sheet was prepared in accordance with the following method:

An intermediate layer coating liquid with the following formulation was coated on a commercially available synthetic paper "Yupo FPG-150" (Trademark), made by Oji-Yuka Synthetic Paper Co., Ltd., serving as a support, by using a wire bar, and dried at 75° C. for one minute, so that an intermediate layer with a thickness of about 5 μm on a dry basis was formed on the support.

Formulation of Intermediate Layer Coating Liquid

| | Parts by Weight |
|---|---|
| Vinyl chloride - vinyl acetate - vinyl alcohol copolymer "VAGH" (Trademark) made by Union Carbide Japan K.K. | 10 |
| Diisocyanate "Coronate L" (Trademark) made by Nippon | 5 |

Comparative Examples 7 and 8

The procedure for fabrication of the sublimation-type thermal color image transfer recording medium No. 8 of the present invention in Example 8 was repeated except that the values of L, R and M.L/R were changed as shown in the following TABLE 13, whereby comparative sublimation-type thermal color image transfer recording media No. 7 and No. 8 were fabricated:

TABLE 13

| Ex. | Color Ink Layer Section | Dye | M ($g/m^2$) | L ($\times 10^{-2}$) | R ($\times 10^{-2}$) | M · L/R ($g/m^2$) |
|---|---|---|---|---|---|---|
| Comp. Ex. 7 | Yellow Ink Layer Section | (Y-2) + (Y-3) | 4.6 | 1.0 | 28.5 | 0.16 |
| | Magenta Ink Layer Section | (M-J) + (M-4) | 7.5 | 1.0 | 28.5 | 0.26 |
| | Cyan Ink Layer Section | (C-2) + (C-3) | 7.7 | 1.0 | 28.5 | 0.27 |
| Comp. Ex. 8 | Yellow Ink Layer Section | (Y-2) + (Y-3) | 4.6 | 4.1 | 28.5 | 0.66 |
| | Magenta Ink Layer Section | (M-1) + (M-4) | 6.3 | 4.1 | 28.5 | 0.91 |
| | Cyan Ink Layer Section | (C-2) + (C-3) | 7.7 | 4.1 | 28.5 | 1.10 |

-continued

| | Parts by Weight |
|---|---|
| Polyurethane Industry Co., Ltd. | |
| Toluene | 40 |
| Methyl ethyl ketone | 40 |

An image receiving layer coating liquid with the following formulation was then coated on the above provided intermediate layer, by using a wire bar, and dried at 75° C. for one minute, so that an image receiving layer with a thickness of about 5 μm was formed on the intermediate layer:

Formulation of Intermediate Layer Coating Liquid

| | Parts by Weight |
|---|---|
| Vinyl chloride - vinyl acetate - vinyl alcohol copolymer "VAGH" (Trademark) made by Union Carbide Japan K.K. | 10 |
| Diisocyanate "Coronate L" (Trademark) made by Nippon Polyurethane Industry Co., Ltd. | 5 |
| Amino-modified silicone oil "SF8417" (Trademark) made by Dow Corning Toray Silicone Co., Ltd. | 0.5 |
| Epoxy-modified silicone oil "SF8411" made by Dow Corning Toray Silicone Co., Ltd. | 0.5 |
| Toluene | 40 |
| Methyl ethyl ketone | 40 |

The above obtained laminated material was heated to 60° C. and the temperature was maintained for 24 hours for curing the coated layers, whereby an image receiving sheet was prepared.

Images were transferred from each of sublimation-type thermal color image transfer recording media Nos. 1 to 8 of the present invention and comparative sublimation-type thermal color image transfer recording media Nos. 1 to 8 to the above obtained image receiving street by the application of heat through a thermal head under the following conditions:

| | |
|---|---|
| Resolution of thermal head: | 12 dots/mm |
| Applied energy: | 0.64 mJ/dot |
| Applied electric power: | 1.6 W/dot |
| Transporting speed of image receiving sheet: | 8.4 mm/sec |

The density of each of the thus obtained images was evaluated by use of a reflection-type Macbeth Densitometer RD-918.

Image densities obtained by use of sublimation-type thermal color image transfer recording media Nos. 1 to 8 of the present invention and comparative sublimation-type thermal color image transfer recording media Nos. 1 to 8 were evaluated with the respective L/R values set as shown in TABLES 2, 4, 6, 7, 9, 10, 12 and 13, and also with the L/R values set twice those shown in TABLES 2, 4, 6, 7, 9, 10, 12 and 13.

In addition to the above, image patterns with a mixture of the three colors, yellow, magenta and cyan, were formed on the image receiving sheet, using each recording medium, and the obtained image patterns were visually inspected for evaluation.

The results of the evaluation of sublimation-type thermal image transfer recording media Nos. 1 to 8 of the present invention and comparative sublimation-type thermal image transfer recording media Nos. 1 to 8 are respectively shown in TABLE 14 and TABLE 15.

TABLE 14

| Ex. No. | Recording density when L/R is set as shown in Tables 2, 4, 6 9, 10 and 12 | | | Recording density when L/R is set twice that shown in Tables 2, 4, 6 9, 10 and 12 | | | Image Pattern |
|---|---|---|---|---|---|---|---|
| | y | m | c | y | m | c | |
| Ex. 1 | 2.2 | 2.4 | 2.3 | 2.3 | 2.4 | 2.2 | excellent |
| Ex. 2 | 2.0 | 2.4 | 2.3 | 2.2 | 2.4 | 2.2 | excellent |
| Ex. 3 | 2.2 | 2.3 | 2.3 | 2.3 | 2.4 | 2.2 | excellent |
| Ex. 4 | 2.2 | 2.3 | 2.2 | 2.3 | 2.4 | 2.3 | excellent |
| Ex. 5 | 2.3 | 2.2 | 2.3 | 2.3 | 2.3 | 2.3 | excellent |
| Ex. 6 | 2.2 | 2.4 | 2.3 | 2.3 | 2.4 | 2.2 | excellent |
| Ex. 7 | 2.0 | 2.3 | 2.2 | 2.2 | 2.4 | 2.3 | excellent |
| Ex. 8 | 2.3 | 2.3 | 2.3 | 2.3 | 2.3 | 2.3 | excellent |

TABLE 15

| Comp. Ex. No. | Recording density when L/R is set as shown in Tables 4, 7, 10 and 13 | | | Recording density when L/R is set twice that shown in Tables 4, 7, 10 and 13 | | | Image Pattern |
|---|---|---|---|---|---|---|---|
| | y | m | c | y | m | c | |
| Comp. Ex. 1 | 1.7 | 1.8 | 1.7 | 2.0 | 2.4 | 2.3 | insufficient density |
| Comp. Ex. 2 | 2.4 | 2.4 | 2.3 | 2.2 | 2.4 | 2.3 | excellent |
| Comp. Ex. 3 | 1.8 | 1.5 | 1.8 | 2.4 | 2.2 | 2.3 | insufficient density |
| Comp. Ex. 4 | 2.3 | 2.3 | 2.3 | 2.4 | 2.3 | 2.4 | excellent |
| Comp. Ex. 5 | 1.7 | 1.8 | 1.7 | 2.0 | 2.4 | 2.3 | insufficient density |
| Comp. Ex. 6 | 2.4 | 2.4 | 2.3 | 2.2 | 2.4 | 2.3 | excellent |
| Comp. Ex. 7 | 1.8 | 1.5 | 1.8 | 2.4 | 2.2 | 2.3 | insufficient density |
| Comp. Ex. 8 | 2.3 | 2.3 | 2.3 | 2.4 | 2.3 | 2.4 | excellent |

In TABLES 14 and 15, symbols y, m and c respectively indicate yellow color, magenta color and cyan color.

The results shown in TABLE 14 and 15 indicate that even when the relative speed of the recording media, L/R, is set at twice, the image densities obtained are almost the same as those obtained at the relative speed of the recording media as shown in TABLES 2, 4, 6, 7, 9, 10, 12 and 13. This indicates that it is possible to increase the relative speed of the image receiving sheet, R/L, and accordingly it is possible to increase the value "n" of the n-times-speed mode method.

On the other hand, if image density is increased when the relative speed of the recording media, L/R, is set twice, a low image density is provided at the L/R values set in TABLES 2, 4, 6, 7, 9, 10, 12 and 13, so that it is necessary to decrease the value of "n" to some extent.

The results shown in TABLE 14 indicate that the image density and the quality of image patterns are excellent.

In contrast to this, in the case of the comparative sublimation-type thermal image transfer recording media, there are two types of recording media, each having its own problem. In one type of recording media, as in tile case of comparative sublimation-type thermal color image transfer recording media Nos. 1, 3, 5 and 7 in Comparative Examples 1, 3, 5 and 7, the concentration of the ink contained therein is too low to be used repeatedly. In the other type of recording media, as in the case of comparative sublimation-type thermal color image transfer recording media Nos. 2, 4, 6, and 8 in Comparative Examples 2, 4, 6 and 8, the concentration of the ink contained therein is excessively high.

The above comparative sublimation-type thermal image transfer recording media are of a poor commercial value in contrast to the examples of the sublimation-type thermal image transfer recording medium according to the present invention.

The sublimation-type thermal image transfer recording media Nos. 6 to 8 of the present invention were fabricated with such a length that corresponds to a unit length for each ink layer in a subscanning direction thereof necessary for the formation of one picture plane. As a matter of course, it is possible to change the unit length when necessary. For instance, the length of the ink layer in each color portion necessary for the formation of m picture planes can be provided as a unit length (m is an integer of 2 or more).

The sublimation-type thermal color image transfer recording medium of the present invention has the advantages that the multiple-times image transfer performance thereof is excellent.

Moreover, by providing the low-dyeable resin layer overlaid on the dye-transfer-contribution layer, it is possible to prevent the reduction in image quality while in use.

By the screen printing method, the dye-supply layer with the desired thickness can be formed in one step, and as a result, the manufacturing cost of the sublimable-type thermal image transfer recording medium can be decreased.

Furthermore, the sublimation-type thermal image transfer recording medium according to the present invention can be worked into a ribbon-shaped recording medium in general use.

In addition to the above, the sublimation-type thermal color image transfer recording medium according to the present invention can be provided with sensor markers, which are particularly convenient for use when the recording medium is a ribbon-shaped ink ribbon.

What is claimed is:

1. A sublimation thermal color image transfer recording medium for transferring images onto an image receiving sheet by moving said sublimation thermal color image transfer recording medium with a speed of 1/n ($n>1$) relative to said image receiving sheet with a speed of 1, comprising at least one support, and an ink layer formed on said support, said ink layer comprising:

at least one dye-supply layer formed on said support, comprising a resin binder agent and one sublimable dye dispersed therein, said sublimable dye being selected from the group consisting of a yellow sublimable dye, a magenta sublimable dye, and a cyan sublimable dye; and a dye-transfer-contribution layer formed on said dye-supply layer, comprising a resin binder agent and a sublimable dye with substantially the same color as that of said sublimable dye in said dye-supply layer, wherein the total of said sublimable dye contained in said dye-supply layer and that in said dye-transfer contribution layer is M $g/m^2$, thereby forming at least one color portion selected from the group consisting of a yellow color portion, a magenta color portion and a cyan color portion in said ink layer, the value of M.1/n for said yellow color portion is in the range of 0.2 $g/m^2$ to 0.5 $g/m^2$, the value of M.1/n for said magenta color portion is in the range of 0.3 $g/m^2$ to 0.8 $g/m^2$ and the value of M.1/n for said cyan color portion is in the range of 0.3 $g/m^2$ to 0.8 $g/m^2$.

2. The sublimation thermal color image transfer recording medium as claimed in claim 1, wherein said ink layer further comprises a low-dyeable resin layer which is provided on said dye-transfer-contribution layer.

3. The sublimation thermal color image transfer recording medium as claimed in claim 1, wherein said support is a ribbon-shaped support comprising a plurality of portions corresponding to a plurality of ink layer group sections arranged in the longitudinal direction of said ribbon-shaped support, each of said ink layer group sections comprising a yellow ink layer section, a magenta ink layer section, and a cyan ink layer section; and said ink layer comprises (a) three dye-supply layers formed on said ribbon-shaped support, a first dye-supply layer of said three dye-supply layers being a yellow dye-supply layer which comprises said resin binder agent and said yellow sublimable dye and is provided in said yellow ink layer section of said ribbon-shaped support, a second dye-supply layer of said three dye-supply layers being a magenta dye-supply layer which comprises said resin binder agent and said magenta sublimable dye and is provided in said magenta ink layer section, and a third dye-supply layer of said three dye-supply layers being a cyan dye-supply layer which comprises said resin binder agent and said cyan sublimable dye and is provided in said cyan ink layer section, and (b) three dye-transfer-contribution layers formed on said three-dye supply layers, a first dye-transfer-contribution layer formed on said first dye-supply layer, comprising a resin binder agent and a sublimable dye with substantially the same color as that of said sublimable dye in said first dye-supply layer, a second dye-transfer-contribution layer formed on said second dye-supply layer, comprising a resin binder agent and a sublimable dye with substantially the same color as that of said sublimable dye in said second dye-supply layer, and a third dye-transfer-contribution layer formed on said third dye-supply layer, comprising a resin binder agent and a sublimable dye with substantially the same color as that of said sublimable dye in said third dye-supply layer.

4. The sublimation thermal color image transfer recording medium as claimed in claim 1, wherein said dye-supply layer is formed by a screen printing method.

5. The sublimation thermal color image transfer recording medium as claimed in claim 3, wherein said three dye-supply layers are formed by a screen printing method.

6. The sublimation thermal color image transfer recording medium as claimed in claim 3, further comprising a sensor marker, which is provided in a boundary area between each of said ink layer group sections.

7. The sublimation thermal color image transfer recording medium as claimed in claim 3, further comprising a sensor marker, which is provided in a boundary area between each of said yellow ink layer, said magenta ink layer, and said cyan ink layer.

8. The sublimation thermal color image transfer recording medium as claimed in claim 1, wherein said support comprises a plurality of separate support members, and at least one of said yellow ink layer section, said magenta ink layer section, and said cyan ink layer section is provided on any of said separate support members, thereby constituting a set of separate sublimation thermal color image transfer recording media.

9. The sublimation thermal color image transfer recording medium as claimed in claim 1, wherein said dye-supply layer has a thickness in the range of 0.1 to 20 μm, and said dye-transfer-contribution layer has a thickness of in the range of 0.05 to 5 μm.

* * * * *

UNITED STATES PATENT AND TRADEMARK OFFICE

CERTIFICATE OF CORRECTION

PATENT NO. : 5,376,619

DATED : December 27, 1994

INVENTOR(S) : Hidehiro MOCHIZUKI et al

It is certified that error appears in the above-identified patent and that said Letters Patent is hereby corrected as shown below:

Column 3, line 42, "M.1/n" should read --M·1/n--;
line 43, "M.1/n" should read --M·1/n--;
line 45, "M.1/n" should read --M·1/n--;
line 64, "Layer" should read --layer--.
Column 4, line 6, "M.1/n" should read --M·1/n--;
line 7, "M.1/n" should read --M·1/n--.
Column 5, line 53, "M.1/n" should read --M·1/n--;
line 58, "M.1/n" should read --M·1/n--;
line 60, "M.1/n" should read --M·1/n--;
line 63, "M.1/n" should read --M·1/n--.
Column 6, line 10, "M.1/n" should read --M·1/n--;
line 15, "M.1/n" should read --M·1/n--;
line 19, "M.1/n" should read --M·1/n--;
line 23, "M.1/n" should read --M·1/n--.
Column 7, line 59, "is be used" should read --is used--.
Column 9, line 13, "tile" should read --the--.
Column 10, line 22, "is" should read --does--.
Column 11, line 24, "as a the" should read --as a--.
Column 12, line 44, "support of" should read --support--.

UNITED STATES PATENT AND TRADEMARK OFFICE

CERTIFICATE OF CORRECTION

PATENT NO. : 5,376,619

DATED : December 27, 1994

INVENTOR(S) : Hidehiro MOCHIZUKI et al

It is certified that error appears in the above-identified patent and that said Letters Patent is hereby corrected as shown below:

Column 13, line 48, "coating is" should read --coatings are--.

Column 16, line 44, "M.L/R" should read --M·L/R--.

Column 17, line 26, "M.L/R" should read --M·L/R--.

Column 20, line 60, "M.L/R" should read --M·L/R--.

Column 21, line 20, "M.L/R" should read --M·L/R--.

Column 24, line 22, "M.L/R" should read --M·L/R--;

line 46, "M.L/R" should read --M·L/R--.

Column 25, line 47, " (Trademark" " should read --(Trademark)--;

line 49, " (Trademark" " should read --(Trademark)--.

Column 27, line 57, "M.L/R" should read --M·L/R--.

Column 28, line 17, "M.L/R" should read --M·L/R--.

UNITED STATES PATENT AND TRADEMARK OFFICE

CERTIFICATE OF CORRECTION

PATENT NO. : 5,376,619

DATED : December 27, 1994

INVENTOR(S) : Hidehiro MOCHIZUKI et al

It is certified that error appears in the above-identified patent and that said Letters Patent is hereby corrected as shown below:

Column 32, line 2, "M.1/n" should read --M·1/n--;
line 4, "M.1/n" should read --M·1/n--;
line 6, "M.1/n" should read --M·1/n--.

Signed and Sealed this

Twenty-third Day of July, 1996

*Attest:*

Bruce Lehman

BRUCE LEHMAN

*Attesting Officer*

*Commissioner of Patents and Trademarks*